United States Patent [19]

Wood

[11] Patent Number: 4,899,943

[45] Date of Patent: Feb. 13, 1990

[54] MANUAL CYLINDER FOR ROLLS

[75] Inventor: Ray M. Wood, Dalhart, Tex.

[73] Assignee: Dalhart R & R Machine Works, Inc., Dalhart, Tex.

[21] Appl. No.: 313,741

[22] Filed: Feb. 22, 1989

[51] Int. Cl.[4] ..... B02C 4/38

[52] U.S. Cl. ..... 241/232; 241/287

[58] Field of Search ..... 72/240, 246, 248; 241/37, 230–234, 286–290

[56] References Cited

U.S. PATENT DOCUMENTS 791,833 6/1905 Snyder ..... 241/232

3,107,869 10/1963 McIntire ..... 241/232

FOREIGN PATENT DOCUMENTS 542621 1/1942 United Kingdom ..... 241/232

*Primary Examiner*—Mark Rosenbaum

*Attorney, Agent, or Firm*—Wendell Coffee

[57] ABSTRACT

The moveable roll of a rolling mill is locked in the engaged position by lock means which include a tension shaft. The tension shaft is telescoped through and biased by a compression spring toward the stationary roll. The end of the tension shaft has an eccentric which causes a housing pad to engage arms carrying the bearings of the moveable roll.

12 Claims, 2 Drawing Sheets

MANUAL CYLINDER FOR ROLLSpg,6

BACKGROUND OF THE INVENTION:

(1) Field of the Invention

This invention relates to roller mills for grain, and more particularly to a roller mill for rolling cooked feed for cattle.

(2) Description of the Related Art

It is common to feed cattle being fattened for slaughter steamed feed. After the feed is steamed, it is rolled.

When grain is not being fed to the roller mill, the rolls are normally separated or disengaged. When the roller mill is rolling the grain, they are in an engaged position. The engaged position does not necessarily mean that the rolls are contacting one another. Often, they will be separated by 1/64" or less to properly roll the grain. The exact degree of separation depends not only upon the material that is being rolled, but also upon the individual preference of the management.

When the rolls are engaged, they are separated by the prescribed amount by rigid adjustable stops. They are held against the stops by heavy springs. The springs normally hold the rolls against the stops for the minimum clearance, except when a foreign object is in the grain. Regardless of all precautions, often a foreign object such as a piece of metal or other hard object will be in the feed. It is desirable for the rolls to spring open on such an occasion.

Also, it is necessary that the two ends of the rolls or the two bearing blocks holding the rolls be moved forward and back in unison.

The rolls or bearing blocks may be moved only about ¼" between the engaged and disengaged positions. One roll is stationary and the other is moved between the engaged and disengaged position.

Before my invention, about 90% of the rolls were moved into position by hydraulic cylinders. These hydraulic cylinders operated a tension shaft which moved axially. The axial movement of each tension shaft compressed its spring. The compressed spring exerted about 2,500 pounds of force on the tension shaft.

The distal end of the shaft had a compression spring attached thereto. The distal end and compression spring extended outward from the rolling mill. A housing pad attached to the spring would move the bearing block and thus, the moveable rolls. Since the cylinders operated on hydraulic fluid, it was normally necessary for their operation that the location of the roller mills have available electricity and compressed air for the pressure feed of the hydraulic pumps.

SUMMARY OF THE INVENTION:

(1) Progressive Contribution to the Art

I have invented a simple manual system for moving and locking the rolls between the positions of being disengaged to engaged. According to my invention, a heavy spring is contained within a tubular spring holder which is basically a cylinder having a square cross section. The spring is a compression spring with one end bearing against a clearance adjusting nut on the spring holder and the other end against a spring nut upon a tension shaft.

The tension shaft is telescoped through the compression spring and through the clearance adjusting nut. The distal end of the tension shaft has a housing pad mounted thereon. The housing pad is moved relative to the tension shaft by an eccentric upon a connecting shaft which extends from one tension shaft to the other. The housing pad engages an arm carrying the moveable roll against the adjusting nut as in the pneumatic operators as commonly on the market today.

The spring is preloaded by rotating the tension shaft so that threads on the tension shaft through the spring nut compress the spring until there is the desired force to be applied to the rolls. E.g., the spring would be compressed until it exerted about 2,500 pounds against the spring nut. One end of the tension shaft bears against the end of the clevis in the disengaged or unengaged position.

The clearance between the rolls is set by the clearance adjustment nut which is on the end of the spring holder. Since one end of the spring holder is pivoted to the frame and the clearance adjustable nut buts against the arm carrying the moveable bearing, this adjusts the minimum clearance. This adjustment on the minimum clearance is the same as the prior art hydraulic cylinders. However, in the prior art, the adjustment nut is located on the hydraulic cylinder. In this invention, the spring holder occupies the same position as previously occupied by the hydraulic cylinder and the clearance adjustment is the same as upon the prior art devices.

Objects of this Invention

An object of this invention is to engage and disengage the moveable roll of a rolling mill.

Another object of this invention is to move one of the rolls within a cattle feeding plant to properly roll feed for cattle.

Further objects are to achieve the above with devices that are sturdy, compact, durable, lightweight, simple, safe, efficient, versatile, ecologically compatible, energy conserving, and reliable, yet inexpensive and easy to manufacture, connect, adjust, operate and maintain.

The specific nature of the invention, as well as other objects, uses, and advantages thereof, will clearly appear from the following description and from the accompanying drawing, the different views of which are not scale drawings.

Figure 1:
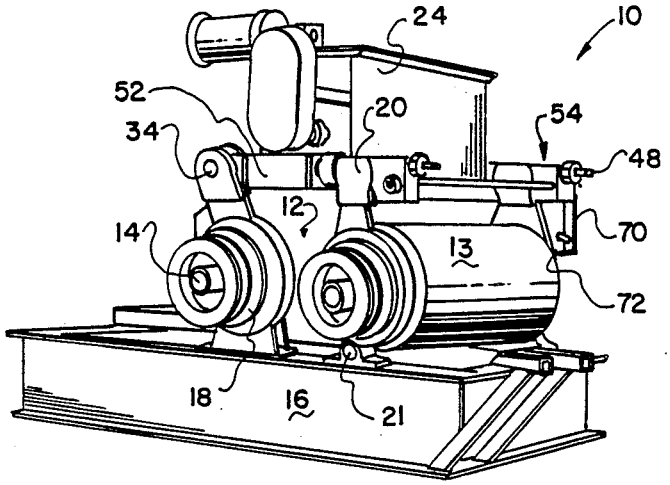
FIG. 1 is a perspective view of a roller mill with my invention mounted thereon.

As an aid to correlating the terms of the claims to the exemplary drawing, the following catalog of elements and steps is provided:

10—roller mill
12—stationary roll
13—moveable roll
14—roll shaft
16—frame
18—frame bearings
20—arm 21—axis
22—moving bearings
24—hopper
26—barrel, spring
28—compression spring
30—clevis end
32—clevis
34—ears
36—adjustment nut lock
38—barrel end
40—bolts
42—nipple
44—adjusting nut plate
46—adjusting nut
48—tension shaft
49—tension shaft spring end
50—spring nut
51—distal end
52—spring holder
54—lock means
56—housing pad
58—block
60—tension shaft bore
62—eccentric bore
64—eccentric disk
66—connecting shaft
68—pad bore
70—handle
72—adjusting bolt
74—tension nut
76—wrench flat

DESCRIPTION OF THE PREFERRED EMBODIMENT:

Referring more particularly to the drawings, there may be seen roller mill 10. The mill includes two rolls 12 and 13, each mounted upon roll shaft 14. Frame 16 of the roller mill has two frame bearings 18 mounted upon the frame. One of the rolls is designated as the stationary roll 12, and its shaft 14 is journaled in the frame bearings 18.

Arms 20 are both pivoted to the frame about axis 21. The arms 20 will have a common axis 21 which is parallel to the shafts 14 of the rolls. Moving bearings 22 are mounted on the arms. The shaft 14 of the moveable roll 13 is journaled in the moving bearings 22. Hopper 24, mounted upon the frame 16 of the roller mill 10, feeds grain between the rolls 12 and 13.

Inasmuch as roller mills as described to this point are well known to the art and commercially available on the market, they will not be further described here. Those having skill in the art will understand that there are means for rotating the rolls which have not been shown in the drawings for clarity of the invention.

Barrel 26 with a square cross section carries a two ended helical compression spring 28 therein. Clevis end 30 of the barrel 26 has clevis 32 affixed thereto. The clevis is pinned to ears 34 upon the frame 16 near the frame bearing 18. Clearance adjustment nut 46 is connected to nut end 38 of the barrel 26. Nipple 42 and the clevis 32 are clamped against the barrel 26 by four bolts 40 which extend the length of the barrel within the four corners thereof.

The clearance adjustment nut 46 is threaded on the nipple 42 extending outward from plate 44. The clearance nut 46 is threaded to the nipple. The barrel 26, clevis 32, clearance nut 46, and bolts 40, together are herein called spring holder 52. Lock nut 36 locks the clearance nut 46 in place.

Tension shaft 48 extends through the clearance nut 46, nipple 42, and compression spring 28. Spring end 49 of the tension shaft is threaded into spring nut 50 which has a general square configuration so that it does not rotate within the barrel 26 The spring end 49 bears against the clevis 32.

The other end of tension shaft 48 is designated as distal end 51 which carries lock means 54. The lock means 54 includes housing pad 56 which contacts the moveable arm 20. When the lock means is engaged and locked, the housing pad 56 moves against the arm 20 and forces the arm against clearance nut 46. In the event a foreign object comes between the rolls 12, the arm may move outward against the housing pad, which in turn will move the tension shaft spring end 49 away from the clevis 32; therefore, further compressing the compression spring 28.

The preferred locking means includes block 58 mounted upon distal end 51. The tension shaft 48 is telescoped through tension shaft bore 60 in the block. The block 58 has large eccentric bore 62 therethrough, which is normal to the tension shaft bore 60. Eccentric disk 64 is journaled in the large eccentric bore 62. The eccentric disk 64 is mounted to connecting shaft 66. The axis of connecting shaft 66 is offset from the axis of the eccentric disk 64; therefore, rotation of the connecting shaft 66 will displace the shaft 66 relative to the block 50. The connecting shaft 66 is journaled through pad bore 68 of the pad 56. Therefore, rotation of the connecting shaft 66 will move the housing pad 56 back and forth relative to the tension shaft 48.

The tension nut 74 is mounted upon the distal end of tension shaft 48. The block 58 buts against the tension nut 74. Therefore, when an obstruction between the rolls 12 and 13 tend to move the arms 20, the movement of the arms will move the block 58 which in turn, will cause movement of the tension shaft, which will move the spring end of the tension shaft away from the clevis, and the preloaded compression upon the compression spring 28 will be increased by the movement.

The connecting shaft 66 is rotated by handle 70 connected thereto. The end of the handle has adjusting bolt 72 threaded therein. When the handle 70 is in the engaged position (FIGS. 1 and 6) wherein the rolls 12 and 13 are close together in the grinding or rolling position, the adjustment bolt 72 is against the arm 20 of the roller mill 10. At this point the eccentrics 64 will be past dead center so that pressure between the rolls 12 and 13 will tend to lock the rolls in place. However, a slight rotation of the shaft 66 will bring the eccentrics 64 over dead center so that thereafter further rotation separates them. Actually, the rolls are not separated, but they are permitted to separate, i.e., they are unlocked from the engaged position.

Operations

To adjust the spring compression, first the tension nut 74 is released. Then by wrench flat 76, the tension shaft 48 is rotated so that the spring nut 50 properly compresses the compression spring 28.

Figure 2:
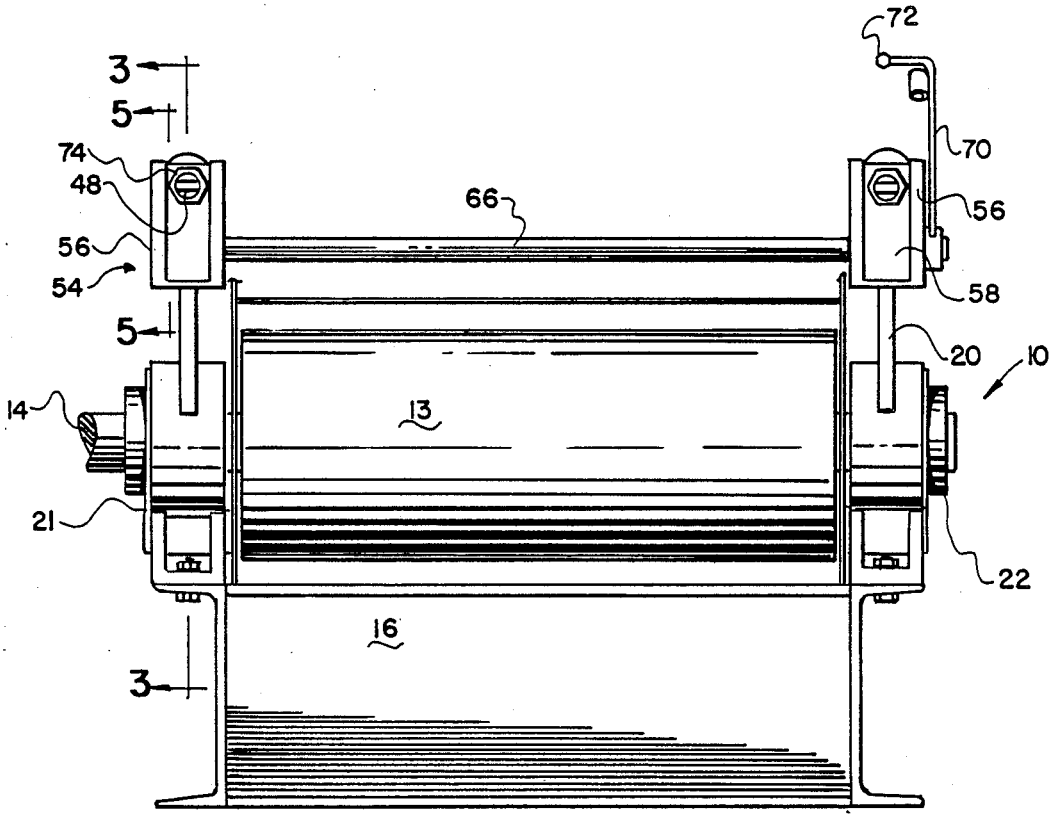
FIG. 2 is an end elevational view of a roller mill with the invention attached thereto in the unengaged position.
Figure 3:
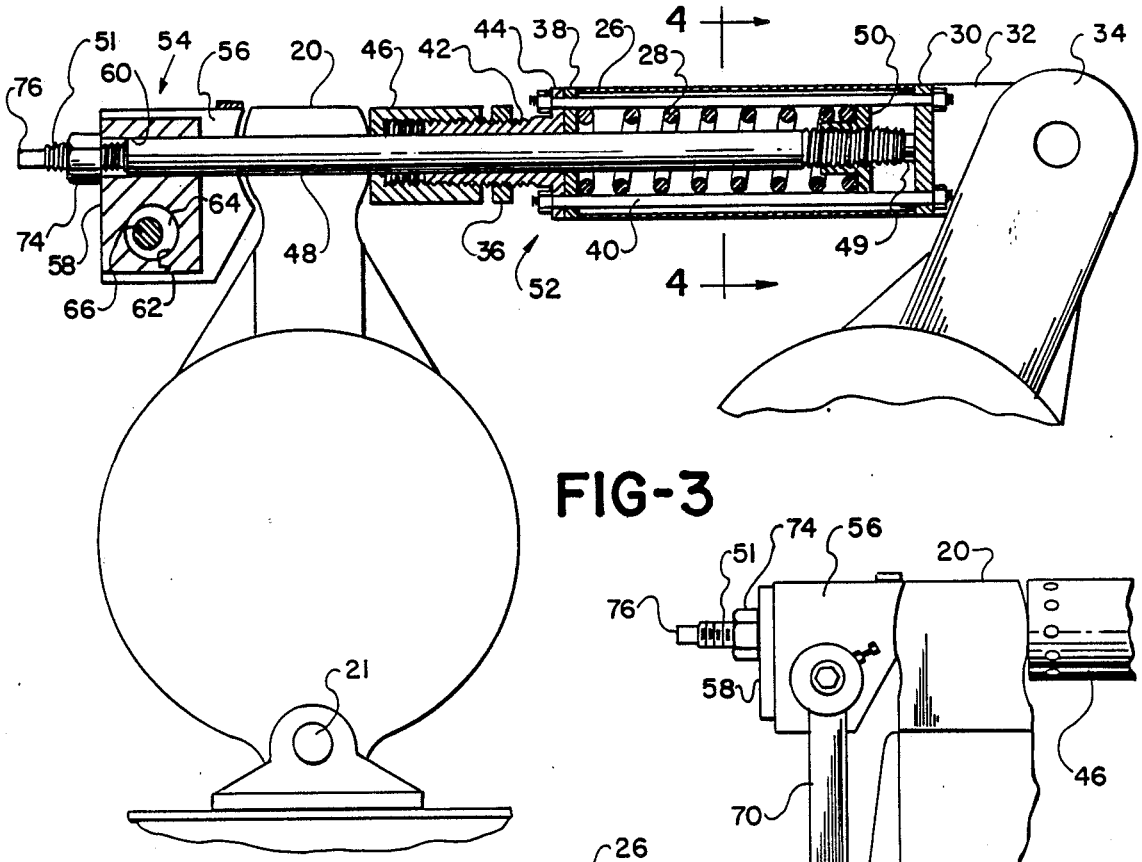
FIG. 3 is a longitudinal sectional view of the engagement cylinder in the unengaged position taken substantially on line 3—3 of FIG. 2.
Figure 6:
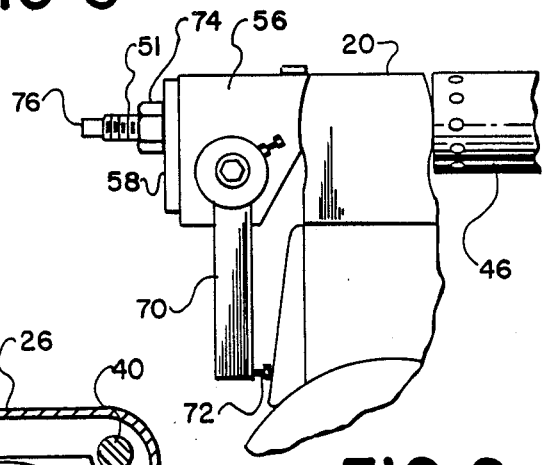
FIG. 6 is a detail view of the adjustment bolt on the handle in the engaged position.
Figure 4:
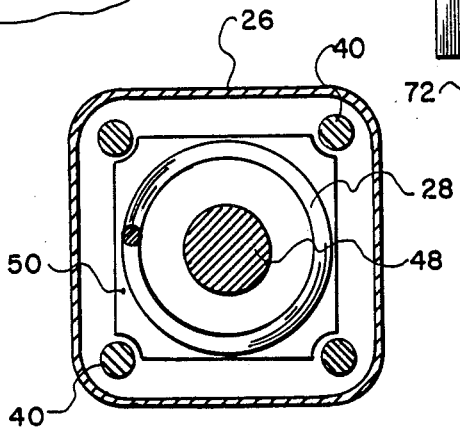
FIG. 4 is a cross sectional view through the spring housing taken substantially on lines 4—4 of FIG. 3.
Figure 5:
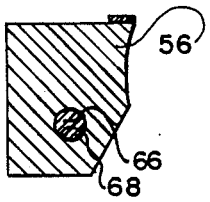
FIG. 5 is a sectional view of the lock means of the tension shaft taken substantially on line 5-5 of FIG. 2.

To adjust roll 13 from roll 12 to give desired clearance, handle 70 is lifted to the disengaged position as in FIG. 2, the adjusting nut 46 is moved to the desired position and then with handle 70, returned to its closed position as in FIG. 6.

Then the adjustment bolt 72 in the handle 70 is adjusted so that the eccentric is past dead center and the force between the rolls holds the lock means 54 securely in position.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. In a roller mill having:

a. a frame, b. a stationary roll and c. a moveable roll, d. each roll having two ends, e. a frame bearing mounted to the frame upon each end of the stationary roll, f. a moving bearing on each end of the moveable roll, and g. an arm pivoted to the frame at each end of the moveable roll having one of said moving bearings mounted thereon;

the improved structure for locking the arms in an engaged position comprising:

h. a pair of two ended spring holders, each one having i. a clevis end attached to the frame near one of the frame bearings, and ii. a nut end, j. a two ended helical compression spring in each spring holder, k. one end of each spring bearing against the nut end of the spring holder, l. a tension shaft having a spring end and a distal end telescoped in each spring, m. a spring nut on a spring end of each tension shaft bearing against the other end of each spring, n. a pair of lock means for moving and locking the arms in the engaged position, o. one of said lock means on a distal end of each tension shaft, p. a connecting shaft extending from one lock means to the other, and q. a handle on the connecting shaft for rotating the connecting shaft which operates said lock means, r. a clearance adjustment nut on the nut end of each of the spring holders bearing against the arm in the engaged position, s. said clearance adjustment nut has a bore therethrough, and t. said tension shaft extends through said bore in said adjusting nut.

2. In a roller mill having:

a. a frame, b. a stationary roll and c. a moveable roll, d. each roll having two ends, e. a frame bearing mounted to the frame upon each end of the stationary roll, f. a moving bearing on each end of the moveable roll, and g. an arm pivoted to the frame at each end of the moveable roll having one of said moving bearings mounted thereon;

the improved structure for locking the arms in an engaged position comprising:

h. a pair of two ended spring holders, each one having i. a clevis end attached to the frame near one of the frame bearings, and ii. a nut end, j. a two ended helical compression spring in each spring holder, k. one end of each spring bearing against the nut end of the spring holder, l. a tension shaft having a spring end and a distal end telescoped in each spring, m. a spring nut on a spring end of each tension shaft bearing against the other end of each spring, n. a pair of lock means for moving and locking the arms in the engaged position, o. one of said lock means on a distal end of each tension shaft, p. a connecting shaft extending from one lock means to the other, and q. a handle on the connecting shaft for rotating the connecting shaft which operates said lock means, r. each of said spring holders includes a closed tubular barrel having a square cross section, and s. the spring end of the tension shaft bears against the clevis end of the spring holder.

3. The invention as defined in claim 2, wherein:

t. said clevis end and nut end of each of the spring holders are held against the barrel by bolts extending from the clevis end to the nut end.

4. The invention as defined in claim 3, wherein:

u. an adjustment nut on the nut end of each of the spring holders bearing against the arm in the engaged position, v. said adjustment nut has a bore therethrough, and w. said tension shaft extends through said bore in said adjusting nut.

5. In a roller mill having:

a. a frame, b. a stationary roll and c. a moveable roll, d. each roll having two ends, e. a frame bearing mounted to the frame upon each end of the stationary roll, f. a moving bearing on each end of the moveable roll, and g. an arm pivoted to the frame at each end of the moveable roll having one of said moving bearings mounted thereon;

the improved structure for locking the arms in an engaged position comprising:

h. a pair of two ended spring holders, each one having i. a clevis end attached to the frame near one of the frame bearings, and ii. a nut end, j. a two ended helical compression spring in each spring holder, k. one end of each spring bearing against the nut end of the spring holder, l. a tension shaft having a spring end and a distal end telescoped in each spring, m. a spring nut on a spring end of each tension shaft bearing against the other end of each spring, n. a pair of lock means for moving and locking the arms in the engaged position, o. one of said lock means on a distal end of each tension shaft, p. a connecting shaft extending from one lock means to the other, and q. a handle on the connecting shaft for rotating the connecting shaft which operates said lock means, r. the spring end of the tension shaft bears against the clevis end of the spring holder.

6. The invention as defined in claim 5, wherein said lock means includes:

s. a block mounted upon said distal end of said tension shaft, and t. a housing pad having a circular bore therethrough, u. an eccentric disk journaled in the circular bore of the housing pad, v. said connecting shaft connected to said eccentric disk, and w. the block journaled onto said connecting shaft.

7. The invention as defined in claim 6, further comprising:

x. said housing pad contacting said moveable arm, and y. the block contacts a tension nut on the distal end of the tension shaft.

8. The invention as defined in claim 6, further comprising:

x. an adjustable bolt on said handle, y. said adjustable bolt contacting one of the arms when the handle is in the engaged position, z. so that said handle stops in the engaged position with the eccentric past dead center so that the force upon the roll holds the adjustment bolt firmly against the arm.

9. The invention as defined in claim 8, further comprising:

aa. said housing pad contacting said moveable arm, and bb. the block contacts a tension nut on the distal end of the tension shaft.

10. The invention as defined in claim 9, wherein:

cc. said spring holder includes a closed tubular barrel having a square cross section.

11. The invention as defined in claim 10, wherein:

dd. said clevis end and nut end of the spring holder are held against the barrel by bolts extending from the clevis end to the nut end.

12. The invention as defined in claim 11, wherein:

ee. an adjustment nut on the nut end of each of the spring holders bearing against the arm in the engaged position, ff. said adjustment nut has a bore therethrough, and gg. said tension shaft extends through said bore in said adjusting nut.

* * * * *